United States Patent [19]

Meyer et al.

[11] 4,249,281

[45] Feb. 10, 1981

[54] SELF-PROPELLED VACUUM CLEANER

[75] Inventors: Robert B. Meyer; Harold W. Schaefer; Richard E. Kronmiller, all of Bloomington, Ill.

[73] Assignee: National Union Electric Corporation, Greenwich, Conn.

[21] Appl. No.: 61,677

[22] Filed: Jul. 30, 1979

[51] Int. Cl.[3] ..... A47L 9/00

[52] U.S. Cl. ..... 15/340; 15/410

[58] Field of Search ..... 15/340, 410; 180/19 H; 192/48.9, 48.91

[56] References Cited

U.S. PATENT DOCUMENTS

| | | | |
|---|---|---|---|
| 1,459,946 | 6/1923 | Camarata et al. | 15/340 |
| 2,619,209 | 11/1952 | Horn | 15/340 X |
| 2,814,063 | 11/1957 | Ripple | 15/340 X |
| 3,218,876 | 11/1965 | Berger | 15/340 X |
| 3,618,687 | 11/1971 | Ripple et al. | 15/340 X |
| 3,938,216 | 2/1976 | Schmitz et al. | 15/340 |

*Primary Examiner*—Christopher K. Moore
*Attorney, Agent, or Firm*—Alfred E. Miller

[57] ABSTRACT

An upright vacuum cleaner has a single motor on the body thereof, for rotating the vacuum producing fan blade, for rotating the rotary brush, as well as for driving the wheels by way of a clutch. The clutch is driven from the motor shaft by way of Evoloid gearing and a continuously driven bevel pinion, to drive oppositely rotating bevel gears. The handle grip of the cleaner is slidable along the end of the shaft or rod between the handle and the body, and controls a Bowden cable to effect the movement of a pair of clutch plates with respect to corresponding bevel gears, thereby to drive wheels on the body in a reversible manner.

11 Claims, 9 Drawing Figures

Fig. 8.
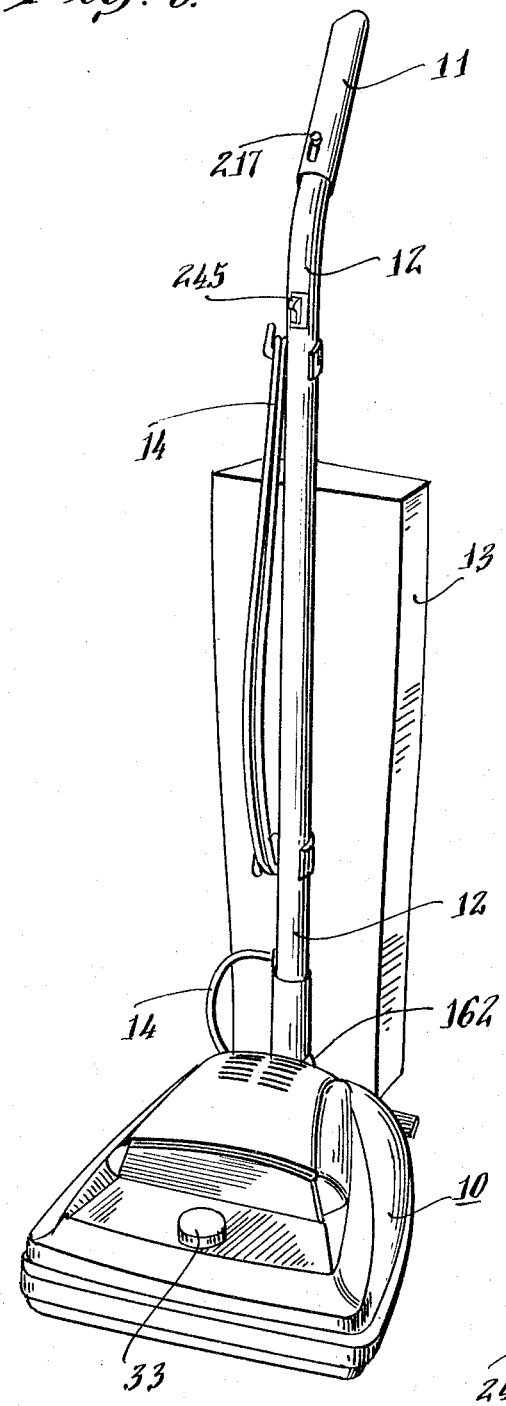
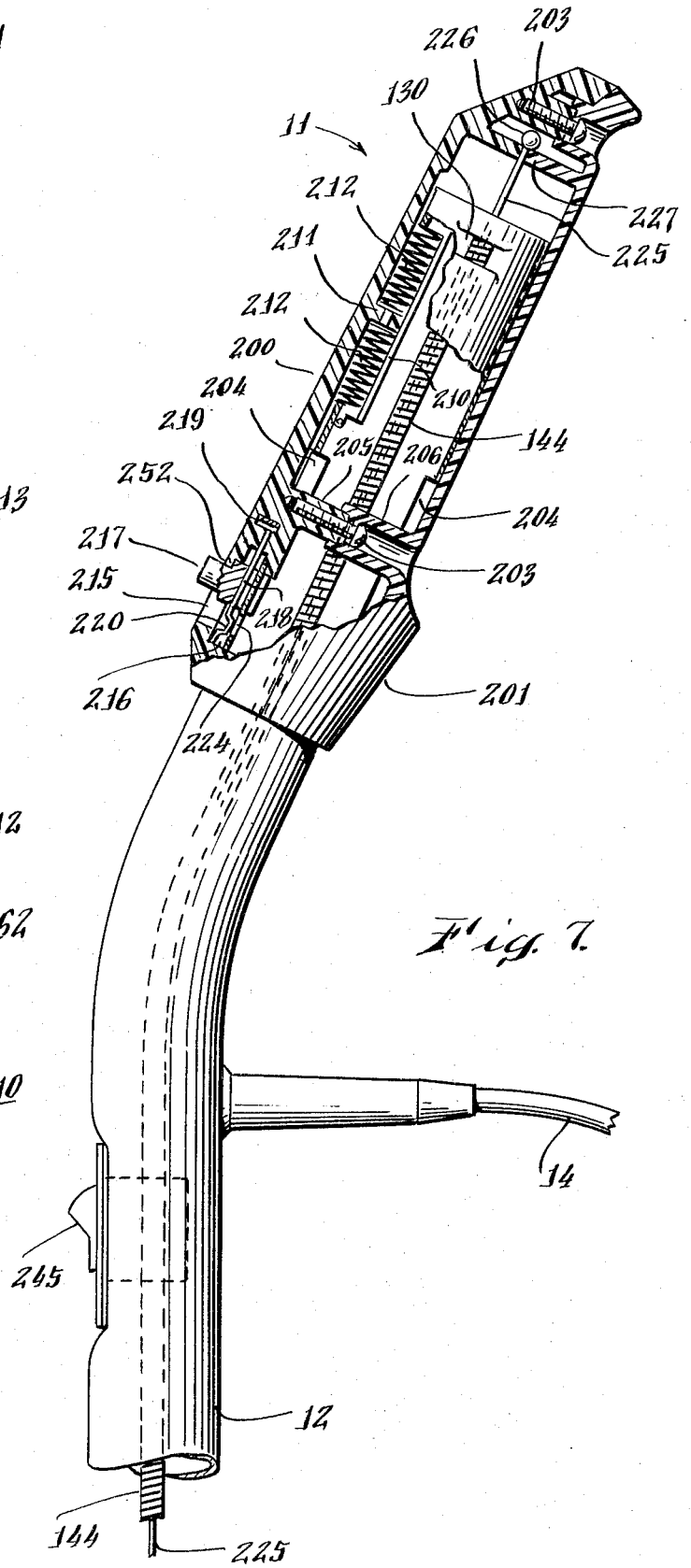
Fig. 7.

SELF-PROPELLED VACUUM CLEANER

BACKGROUND OF THE INVENTION

This invention relates to drive mechanisms for equipment of the type having a ground engaging wheeled unit control by a handle element pivoted to the ground engaging element. The invention is particularly directed to a reversible drive for such equipment, wherein a single multiple function motor is provided on the ground engaging body, such as in a vacuum cleaner, the motor power of the motor also being coupled to drive the body unit along the floor.

While the invention is particularly adaptable for use with upright vacuum cleaners, and will thus be disclosed in the following specification, it is apparent that features thereof may also be adaptable to other equipment, such as but not limited to lawn mowers and the like, without departing from the scope of the invention.

Vacuum cleaners of one type, known as "upright" vacuum cleaners, are comprised of a body unit having floor engaging wheels, and an operating motor incorporated therein. The motor serves to drive a conventional vacuum unit, as well as to rotate a brush roll. This type of vacuum cleaner also is provided with a handle or grip, connected generally pivotably to the body element by way of a rod or shaft, such that an operator may push the body element along a floor.

In the past, the operator has generally provided all of the force necessary for moving the body element along the floor. Since the body element may be relatively heavy due to the incorporation of the motor therein, the use of such vacuum cleaners, particularly those of high capacity, can be fatiguing.

As a result, various forms of motor driven equipment of the above type has been developed. In one general category of the equipment, mechanical coupling means are provided for coupling the motor to the wheels, the coupling means of course requiring the provision of some form of clutch. The clutch controls employed for this purpose have not, to the applicant's knowledge, been entirely satisfactory, since the space permissible for the introduction of the feature of reversible control is limited, and the cost of the motor drive feature must be held to a low value, while still enabling simple and fault free control of the device. In other words, it is difficult to introduce reversible motor drive into such equipment as upright vacuum cleaners, while enabling comfortable control over the motor drive feature in both the forward and reverse directions, such that the operator has no difficulty in controlling the device.

The most natural form of control involves the use of a handle control arranged so that low pressure forces on the handle in the direction of desired movement can effect the operation of the clutch, so that the motive power for the body unit is derived mainly from the motor. By this technique, the drive of the body unit should appear to be "normal", i.e., the operator should have the feeling that the motor is only assisting in the movement of the body or floor unit, whereby a smooth control of the device is attainable. Further, the motor power to the wheels of the body unit should not be influenced by other factors such as, for example, the angle between the floor surface and the pivotable rod or shaft, so that the control unit is not dependent upon the physical stature of the operator.

In a second type of control, the handle may be provided with an electric control device for controlling the wheel drive clutch or clutches. Insofar as the applicants are aware, however, drive systems of this type, especially for vacuum cleaners, have in the past not been commercially acceptable.

The present invention is therefore directed to the provision of a motor driven device of the above type, especially a vacuum cleaner, wherein the above disclosed problems are overcome, and wherein the control of the device is effected by mechanical means.

Briefly stated, in accordance with the invention, an upright vacuum cleaner is provided having a single motor for driving the vacuum pump and the brush rolls, and also for continuously driving a bevel pinion gear by way of Evoloid gears, such that the bevel pinion is continuously driven at a substantially constant rate that is low with respect to the speed of the motor. The bevel pinion continuously drives a pair of bevel gears in relatively opposite directions of rotation, and a Bowden cable is provided coupled to selectively effect the engagement of clutches with the bevel gears, to enable the mechanical coupling to the wheels of the body unit.

The Bowden cable is preferably strung through the control rod or shaft of the device, and is connected to the handle or grip at the upper end thereof, so that relative sliding movement of the handle on the shaft can effect the control of the clutch.

In various other features of the invention, for example, levers interposed between the clutch and the Bowden cable may have notches or projections therein which are adapted to engage a portion of the rod or shaft in an upright position thereof, so that motive power cannot be applied to the wheels in a rest position of the equipment.

Further, a latch, lock or the like may be provided on the handle or grip, to restrain the relative slidable movement thereof, and thereby to enable the operator to provide the sole motive power for the drive wheels.

BRIEF DESCRIPTION OF THE FIGURES

The invention will now be disclosed in greater detail with reference to the accompanying drawings, wherein:

FIG. 7 is a partially cross-sectional view of the handle of a vacuum cleaner in accordance with the invention;

FIG. 8 is a perspective view showing generally a vacuum cleaner of the type which may incorporate the invention.

DETAILED DISCLOSURE OF THE INVENTION

Figure 2:
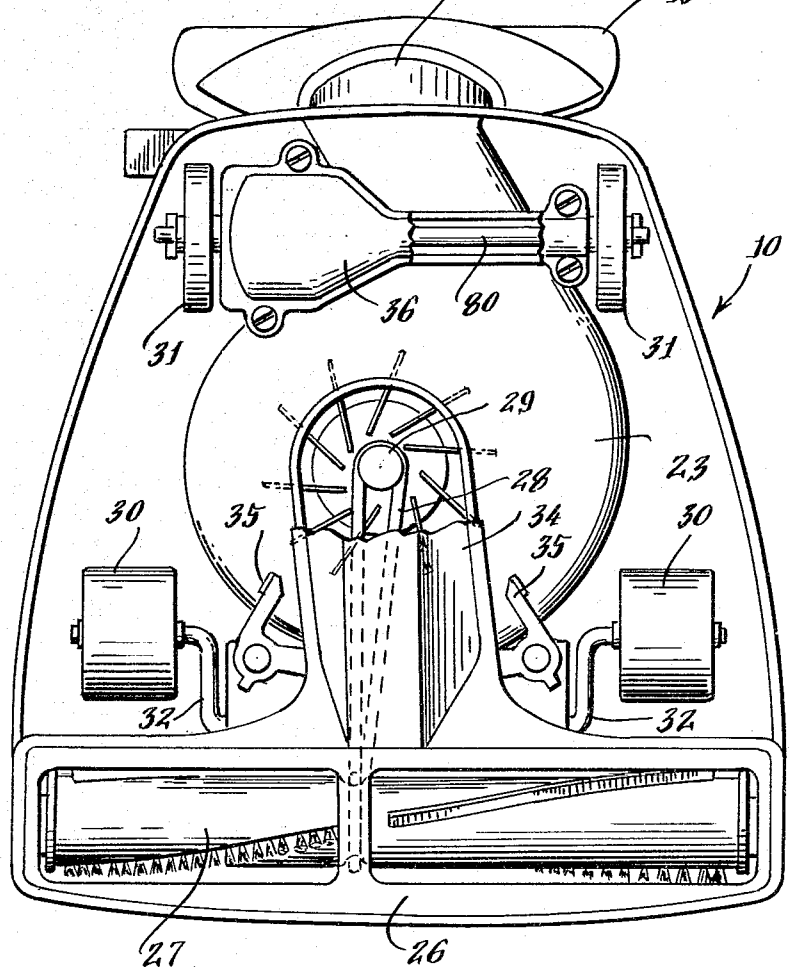
FIG. 2 is an underside view of the vacuum cleaner body of FIG. 1.

Referring now to the drawings, and more in particular to FIG. 8, therein is illustrated a vacuum cleaner of the type to which the present invention is primarily concerned. The vacuum cleaner includes a body member 10 adapted to roll along the floor and including vacuum pickup means and the like. The body 10 is controlled by means of a handle element 11 on the remote end of a rod or the like 12 pivoted to the rear of the body element 10. The rod element 12 may further support the vacuum bag assembly 13, and provide a storage space for electric supply cord 14. In vacuum cleaners of this type, a latch is generally provided so that the rod element 12 may be held in an upright position when the vacuum cleaner is not being propelled, to enable the operator to more easily retrieve the handle when operations are to continue. In the past, aside from the function of providing a comfortable grip for the operator, the handle has also included various other features such as an operating switch or the like.

Figure 1:
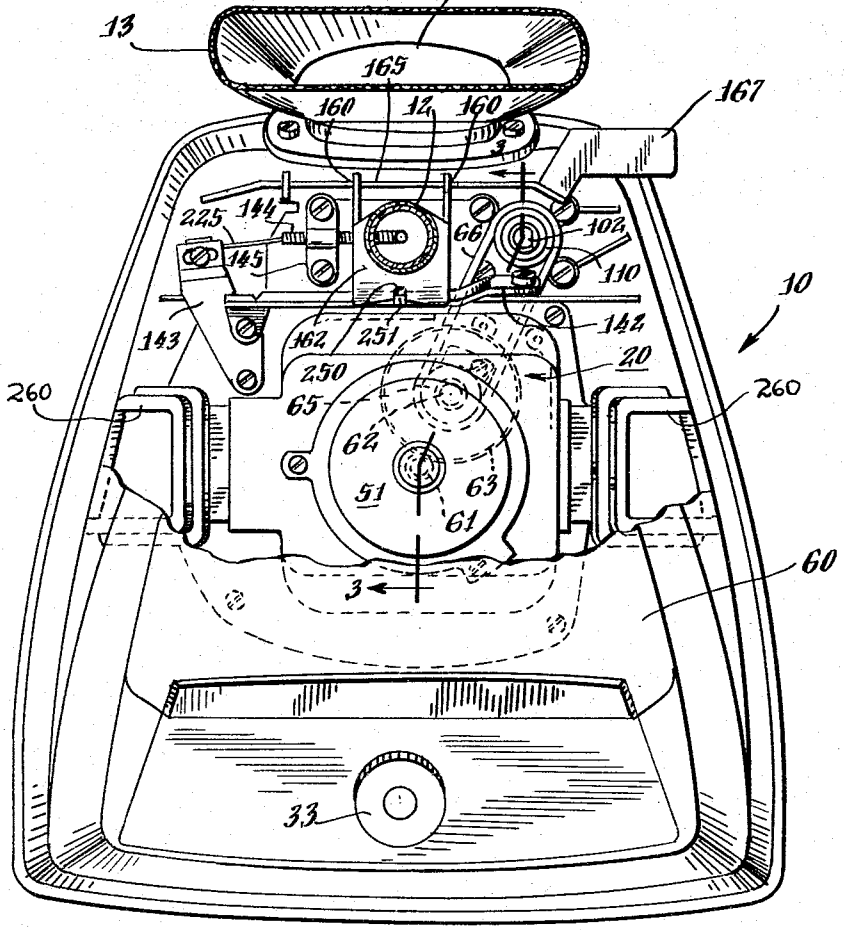
FIG. 1 is a top view of the body unit of a vacuum cleaner in accordance with the invention, the casing for the unit being partially broken away in order to more clearly show the control of the clutch system in accordance with the invention.

In accordance with the present invention, a machine of this type is modified to provide a self-propelled feature. In accordance with the invention, the handle 11 may be slidable with respect to the rod element 12, so that a slight pressure by the operator in the forward direction of the machine will effect a coupling of the vacuum cleaner mover in the body element 10 to drive the entire assembly in a forward direction, and a slight pressure on the handle in the reverse direction will cause a reverse effect at the body element. The control of the vacuum cleaner is effected so that, when the rod element 12 is in the upright position as shown in FIG. 1, this power drive of the assembly is locked out. Further, the handle may have a central position at which a further lock-out arrangement is provided, so that the vacuum cleaner may be operated in the normal fashion, i.e., without power.

It will of course be understood that it is not necessary in accordance with the invention for the vacuum cleaner to have the configuration illustrated in FIG. 8, this configuration constituting only the preferred embodiment of the invention, and that variations in the type of the machine employing the invention are herein contemplated.

Figure 3:
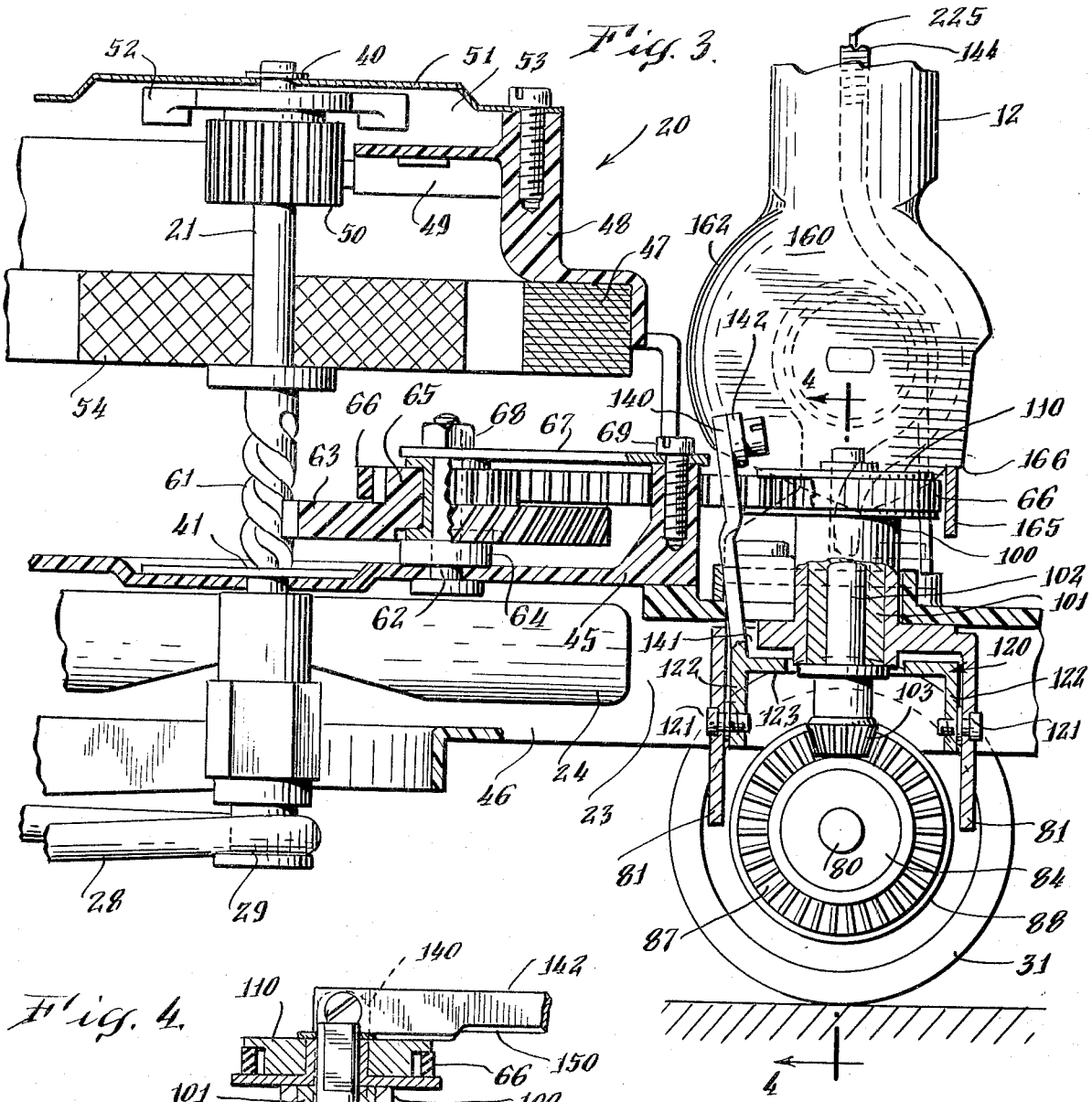
FIG. 3 is an enlarged partially cross-sectional view of the body unit of FIGS. 1 and 2, taken along the lines 3—3 of FIG. 1.

FIGS. 1 and 2 generally indicate the upper and lower views of the body element of the vacuum cleaner, in accordance with the invention, with portions of the coverings thereof removed in order to more clearly disclose the invention. As illustrated in FIG. 1, a motor 20 is mounted generally in the center of the body, the motor having a vertical shaft 21 as illustrated in FIG. 3. The lower end of the shaft 21 extends into a chamber 23, and is therein provided with a vacuum impeller 24. The vacuum chamber 23 communicates with the vacuum outlet duct 25, as seen in FIG. 2, for coupling to the vacuum cleaner bag assembly 13 of FIG. 8, and the intake of this chamber is ducted to the vacuum cleaner nozzle illustrated generally at reference numeral 26. As is conventional, a rotary brush 27 may be provided in the nozzle, rotated by means of a belt 28 extending around a pulley 29 at the extreme lower end of the shaft 21. This portion of the vacuum cleaner assembly is of course conventional.

The above described vacuum cleaner further comprises a pair of forward floor engaging wheels 30 on a common axis forward of the center of gravity in the machine, and at opposite sides of the machine, and a pair of rear wheels 31 on a common horizontal axis parallel to the forward axis, and rearwardly of the center of gravity of the body element. In previous vacuum cleaners, the rear wheels 31 have also been freely rotatable, although it will be seen that in accordance with the present invention these wheels may now be driven. The forward wheels 30 may be mounted on the ends of a bent shaft or crank 32 controlled by a knob 33 (FIG. 1), for example, by means of a cam (not shown), for raising or lowering these wheels, depending upon the carpet surface. This feature, however, is not necessary in a vacuum cleaner in accordance with the invention. As further shown in FIG. 2, a conventional cover assembly 34 is removably mounted over a bottom opening in the vacuum chamber 23, in order to enable access thereto for changing a belt. This cover is held in place by conventional latches 35. The removable cover 36 may also be provided on the bottom of the body element, as shown in FIG. 2, for covering a clutch assembly employed in accordance with the invention.

In accordance with the invention, the power of driving the rear wheels 31 is derived from the motor 20. The coupling from the motor is best illustrated in FIG. 3, wherein the motor shaft 21 is shown supported at the upper bearing 40 and the lower bearing 41 of the motor.

The motor 20 and mounting therefor are perhaps more clearly shown in the cross-sectional view of FIG. 3, where it is seen that the lower frame element 45 for the motor is comprised of a high strength plastic dish-shaped element 45, the lower seal 41 being disposed generally centrally in this element. This lower element defines generally the upper wall of the vacuum chamber 23, and is affixed by suitable conventional means to the body element frame 46. The stator 47 for the motor is supported on the lower frame element 45 by suitable brackets (not shown), and an upper high strength plastic frame element 48 is supported by conventional means on the top of the stator 47. The upper frame element 48 supports the brushes 49, which coact with the commutator 50 on the shaft. A plate 51 is mounted over the upper opening in the element 48, for holding the upper bearing 40 and for confining the motor cooling fan 52 in an upper cooling duct 53 for the motor. The rotor 54 is fixedly mounted on the shaft 21 and aligned with the stator 47. The frame element 46 of the body of the vacuum cleaner may be of a high strength plastic material, and may be covered with a thin casing 60, for example of sheet metal or plastic, as partially illustrated in FIG. 1.

In order to couple the rotation of the shaft to the rear wheels of the vacuum cleaner, gear teeth 61 are provided in the motor shaft 21 between the rotor 54 and lower frame element 45. A gear shaft 62 is fixedly vertically mounted in the frame element 45, and a gear 63 is rotatably mounted on the shaft 62 to mesh with the gear 61. A low friction washer 64 is provided on the lower end of the shaft 62, for axially supporting the gear 63. The gear 63 is preferably of a high strength plastic material, in order to reduce wear and noise, since this gear continuously rotates as long as the vacuum cleaner motor is on. The gear pair 61, 63 has a ratio of about 9 to 1, the rotary speed of the shaft being about 11,000 rpm. In order to be able to couple adequate energy from the shaft 21 in this type of arrangement, it has been found necessary to provide Evoloid gear teeth of the type disclosed, for example, in U.S. Pat. No. 3,247,736.

Pulley 65 and gear 63 are integral, for rotation, the pulley 65 preferably being of the cog type for driving a cog belt 66. The upper end of the shaft 62 may be supported, with respect to the lower motor frame 45, by a plate 67 held to the top of the shaft 62 by a screw 68, and extending to the frame 45 to be held by a further screw 69. It is to be of course appreciated that the frame 45 is provided with suitable apertures for the cog belt 66 to extend laterally therethrough.

In the arrangement of the body unit illustrated especially in FIG. 1, suitable vent units 260 may be provided within the element 10 for directing air to the cooling ducts of the motor. These units are preferably separable units adapted to the interior shape of the body element casing, as well as for engagement with the cooling ducts of the motor, to direct air through suitable vent apertures (not shown) in the casing of the body element 10.

As above discussed, it is a particular feature of the present invention that the motive power for driving the body element 10 along the floor is directly coupled by way of suitable gearing and belt, to the main shaft of the motor. In order to avoid the physical enlargement of the body element 10, this coupling must be effected, in accordance with the invention, internally of the motor. Normally, motors of the type required for vacuum cleaners do not have adequate space for incorporating additional gears affixed to the shaft, and hence, in accordance with the invention, the pinion gear for the drive is machined or otherwise formed on the motor shaft itself. Due to the relatively low diameter of the motor shaft, the number of teeth available for the coupling is a minimum, for example, four teeth may be permitted. As a result, in accordance with the invention it has been found necessary to employ gear teeth for this purpose that can effectively couple a shaft pinion of this type for external driving, on a continuously operating basis.

A further requirement of the gear coupling to the shaft is that the coupling be substantially noise free, since the introduction of a further noise source in the motor of a vacuum cleaner would be undesirable and commercially nonacceptable. The above-mentioned Evoloid gears have been found to satisfy all of these requirements.

Referring now especially to FIG. 3, the rear support wheels 31 are mounted to rotate with a shaft 80, the shaft being bushed at its ends in suitable grooves in the body frame 46 and held therein, for example, by the undercover 36 of FIG. 2 (not illustrated in FIG. 3). This technique for mounting is of course purely illustrative. A clutch frame 81 is affixed to the underside of the body element 46, the frame 81 being formed generally as an open bottom box having bushings 82 (FIG. 4) on a pair of opposite sides through which the shaft 80 rotatably extends. Within this frame 81, clutch elements for the drive of the rear wheels 31 are mounted. Thus, referring to FIGS. 4 and 5, a pair of axially abutting bushings 83, 84 are mounted for rotation with the shaft 80, for example by means of set screws or pins 85. The abutting ends of the bushings 83 and 84 have radially extending flanges, to engage the sides of, and to space apart, a pair of bevel gears 86 and 87 rotatably mounted on the bushings 83 and 84. Clutch discs 88 are provided adjoining the faces of the bevel gears away from one another, and clutch plates 89 and 90 are provided to be axially slidable on the bushings 83 and 84 respectively, axially outwardly of the clutch friction discs 88 and the respective bevel gears 86 and 87. For this purpose, for example, the clutch plates may have radially extending flanges adapted to axially engage the friction discs 88 coextensively therewith, and axially extending hubs upon which annular thrust bearings 91 (FIG. 5) are mounted. The annular bearings 91 may be rolling element bearings or slide bearings. Although the clutch plates 89 and 90 are axially slidable on the bushings 83 and 84, they are rotatable with the bushing, and hence with the shaft 80. For this purpose, axially extending slots 95 may be provided in the hubs of the clutch plates, the set screws or pins 85 for the bushings 83 and 84 being sufficiently long to extend into these slots 95, to inhibit relative rotation of the clutch plates 89, 90 and the shaft 80.

Figure 4:
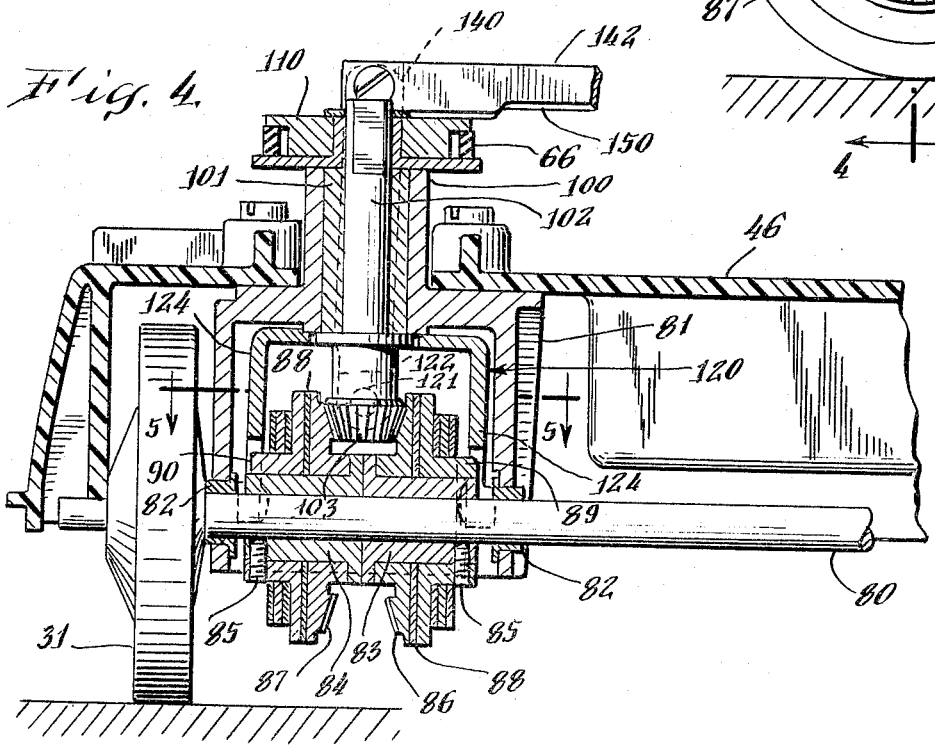
FIG. 4 is a partially cross-sectional view of the clutch assembly of the invention taken along the lines 4—4 of FIG. 3.
Figure 5:
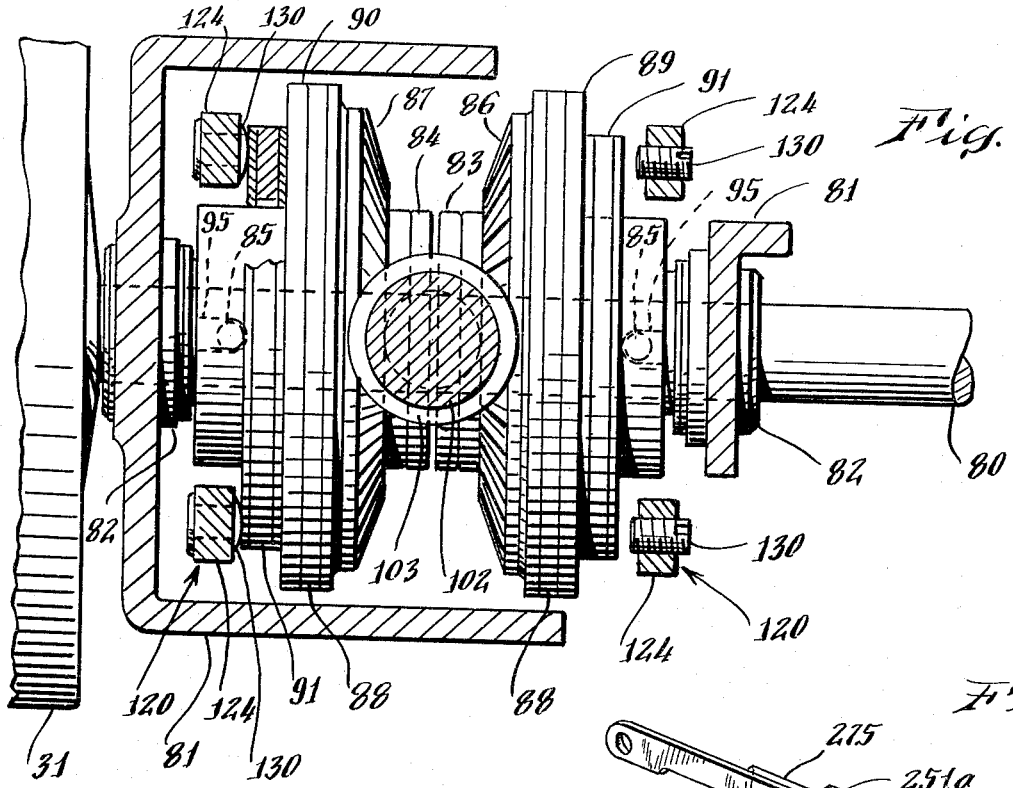
FIG. 5 is a partially cross-sectional view of the clutch assembly illustrated in FIG. 4, and taken along the lines 5—5 of FIG. 4.

As is further evident in FIGS. 3 and 4, A sleeve 100 with a vertical axis extends upwardly from the frame 81 through the cleaner body element 46, and holds a bushing 101 therein. A drive shaft 102 for the clutch is rotatably mounted in the bushing 101, the shaft 102 having a bevel gear pinion 103 on its lower end positioned to continually drive the bevel gears 86 and 87 respectively. While the bevel gears 86 and 87 are not directly axially restrained in a direction away from one another, forces acting on the gear teeth in the axially outward directions do not result in complete separation between the teeth of these gears and the bevel pinion 103 since axial outward movement is ultimately inhibited by the bottoming of the set screws or pins 85 in the respective slots of the clutch plates 89 and 90 respectively. The tolerance provided is not adequate to permit separation of the bevel gears 86 and 87 away from the bevel pinion gear 103.

As shown in FIGS. 3 and 4, a cog belt pulley 110 is mounted on the upper end of the shaft 102, for rotation therewith, the cog belt 66 extending from the motor assembly around the pulley 110. The pulley 110 may be formed of several parts, as illustrated in FIG. 4, to have upper and lower flanges inhibiting accidental removal thereof, while still permitting ready assembly.

The clutch assembly also includes a yoke 120 pivoted for movement about a horizontal axis extending in the front to back direction of the vacuum cleaner. The pivotal mounting of the yoke 120 is best illustrated in FIG. 3, wherein pivot pins or screws 121 are shown extending through the walls of the frame 81, to provide pivot axes for downwardly extending arms 122 at the front and back of the yoke. The yoke has an upper generally horizontal central portion 123, from which a pair of downwardly extending fingers 124 depend on each side thereof (in the axial direction of the shaft 80). The arm 124 on each side of the yoke extend generally symmetrically downwardly with respect to the shaft 80, and are provided at their ends with bearing rivets 130 (FIG. 5), which may be in the form of adjustable screws aligned to engage the axially outer races of the bearings 91 at each side of the clutch assembly, within the frame 81. The bearing rivets 130 are preferably at substantially the horizontal level of the shaft 80, in order to balance the forces applied to the clutch plates. In the neutral position of the clutch, i.e., when the clutch is not engaged to drive the vacuum machine in either the forward or backward direction, there is only a small spacing, for example, about 0.010 inches between the bearing rivets 130 and the facing surfaces of the annular bearings 91.

Figure 6:
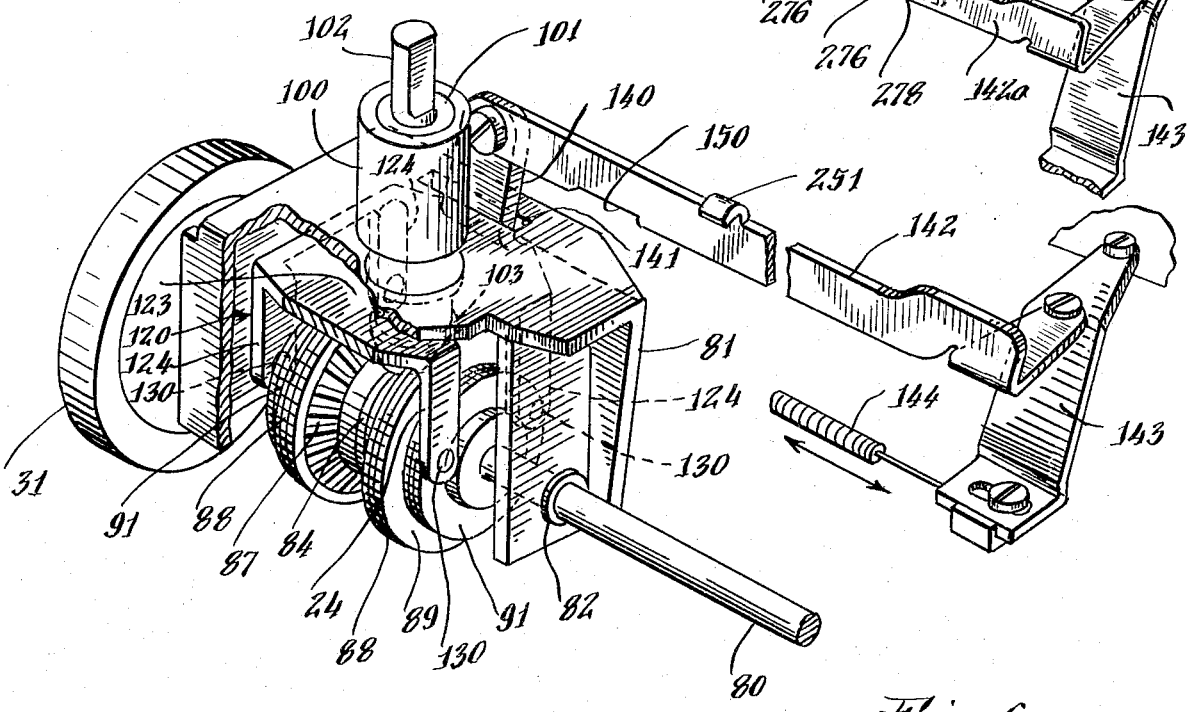
FIG. 6 is a perspective view of a portion of the clutch and clutch drive assembly of the body unit of FIG. 1.

As illustrated most clearly in FIGS. 3 and 6, an upwardly extending arm 140 extends from the generally horizontal center 123 of the yoke, the arm 140 extending upwardly through a slot 141 in the frame 81 and a similar slot in the frame 46, at the front side of the clutch assembly, i.e., towards the front of the vacuum cleaner. As shown in FIGS. 1 and 6, a lever 142 is pivoted to the upper end of the arm 140, and extends horizontally across the top of the vacuum cleaner base between the motor assembly and the rod 12, the lever 142 being pivoted at the opposite side of the machine to a centrally located pivot of a further lever 143. The front end (i.e., toward the front of the vacuum cleaner) of the lever 143 is pivoted to a fixed pivot point, for example, on the frame 45, the other or rearward end of the lever 143 being clamped to the center wire of a Bowden cable 144. The Bowden cable extends from this point to the rod 12 of the vacuum cleaner, with the outer portion thereof being clamped, for example, by clamp 145 (FIG. 1), to the frame 46 of the machine. While the structure of the clutch assembly is being discussed, it will be further pointed out that the lever 142 may have a groove or notch 150 therein (FIG. 6), to avoid interference with the cog belt.

As illustrated in FIG. 3, the lower end of the rod element 12 of the vacuum cleaner is formed to have generally circular sides 160 with flattened lower portions, these vertical end portions 160 being joined by a generally arcuate section 162 illustrated in FIG. 1. The lower end of the rod element 12 is pivoted about a horizontal axis extending generally centrally through the circular plates 160, for example, at an upper extension of the frame 46 or a machine element affixed thereto. The details of this pivoting structure are not of concern to the present invention. The rod element 12 may be held in an upright position by a transversely extending arm 165 engaging a notch 166 in the end plates 160, the lever 165 being pivotable out of engagement with the lower end of the rod element 12 by means of a foot operated pedal 167. The pedal 167 and lever 165 assembly may be mounted on the base element 10 by any conventional means. When the rod element 12 is locked in its substantially vertical position, as illustrated in FIG. 3, a bevelled notch 250 (FIG. 1) in the arcuate portion 162 at the base of the rod element 12 engages a rearwardly extending projection 251 in the lever 142, to thereby inhibit transverse movement of the lever 142. The notch 250 must accordingly be of adequate width to receive the projection 251.

Figure 9:
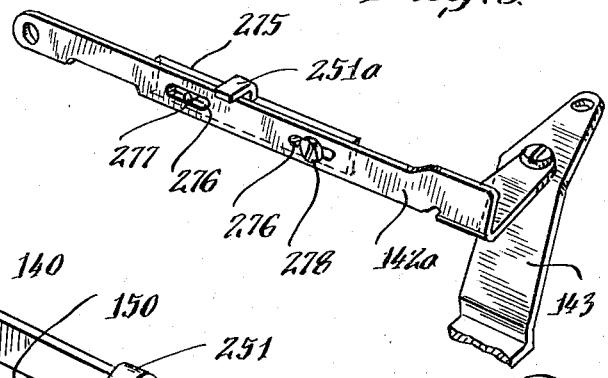
FIG. 9 is a perspective view of a modification of the locking arrangement for the clutch when the handle is in an upright position.

The prevention of transverse movement of the lever 142 effects the locking of the clutch in the neutral position when the projection 251 engages the notch 250 in the upright position of the handle assembly. The dependence upon a projection 251 fixedly formed in the lever 142 may be too critical, however, in view of manufacturing tolerances. It is therefore preferred to provide a degree of adjustability for this neutral locking system, as illustrated in FIG. 9, wherein the projection **251*a* is alternatively provided on a plate 275 adjustably mounted on the lever 142*a*. The adjustability of the mounting may be effected by the provision of a pair of slots 276 extending lengthwise in the central portion of the lever 142*a*, with a pin 277 on the plate 275 slidably extending into one of these slots and a screw 278 threaded in the plate 275 and extending through the other slot 276. It will be apparent that the head of the screw 278 engages the lever 142*a*, when the screw is tightened, to lock the relative position of the plate 275 and the lever 142*a*, and that this screw may be loosened to enable the lengthwise positioning of the projection 251*a*** so that the proper clutch lockout adjustment is provided.

The rod element 12 is hollow, and the Bowden cable thereby extends from the clamp 145 upwardly through the center of the rod element 12 as shown in FIGS. 3 and 7.

Referring now to FIG. 7, the handle element 11 is preferably of a plastic material, formed from an upper shell 200 and a lower shell 201 clamped together by means of screws or rivets 203. For this purpose, suitable slots 204 may be provided on opposite sides of the upper end of the rod element 12, through which bosses 205 and 206 of the elements 200, 201 respectively extend to engage one another for clamping together by means of one of the screws or rivets 203. Another of these screws or rivets 203 may be positioned beyond the upper end of the rod element 12. This mounting thereby covers the upper end of the rod element 12, inhibits removal of the handle element 11 from the top of the rod element 12, and yet permits the handle element 11 to move slidably axially at the end of the rod element 12. This mounting of course also inhibits relative rotation between the handle element 11 and the rod element 12.

A further slot 210 is provided extending axially and adjacent the end of the rod element 12, and a boss 211 extends centrally into this slot from the handle element 200. Helical springs 212 are affixed to the opposite sides of the boss 211, and extend in opposite directions for connection to the insides of the rod element 12 at opposite elements of the slot 210. The springs 212 serve to resiliently hold the handle element 11 at a central position with respect to the slot 210, while permitting resilient movement back and forth therefrom, depending upon forces applied to the handle element 11.

In addition, an axially extending slot 215 may be provided at one end of the handle element 200, i.e., preferably the end thereof toward the vacuum machine, with a groove 216 underlying the slot 215 and having somewhat greater width dimensions. A button 217 is slidably mounted with an enlarged base in the groove 216 and a push-button end extending through the slot 215. A leaf spring 218 extends in the groove 216 between the outer surface of the rod element 12 and the button 217, and has one end thereof fixed with respect to the handle element 200, for example, by extending into a radially outwardly extending aperture 219 at the end of the groove 216. The other end of the leaf spring element 218 is formed with a projection 220 toward the rod element 12, the projection 220 being aligned with a hole 224 in the wall of the rod element 12 in the central or neutral position of the handle element 11. The spring 218 is normally biased away from the hole 224, with the button in a pocket 252 of the slot 215, but when the button 217 is depressed and urged to a forward position it depresses the spring 218 so that the projection 220 enters the hole 224, to inhibit relative sliding movement of the handle element 11 with respect to the rod element 12 from the neutral position thereof.

Still referring to FIG. 7, the Bowden cable 144 extends to a suitable clamp 130 adjacent the upper end of the handle element. The central wire 225 of the Bowden cable has an enlarged upper end 226 which is restrained at the end of the handle element 11, for example, by means of a web 227 extending radially across the inside of the handle element. As a consequence, it is apparent that relative forward and backward movement of the handle element 11 will cause the central wire 225 of the Bowden cable to slip forwardly and backwardly within the outer sheath thereof.

Although the electric cord 14 does not form a part of the invention per se, it will be noted from FIG. 8 that this cord extends also in the upper end of the rod element 12, below the handle element 11, and exists from the rod element 12 above its lower end as shown in FIG. 8. The wire 14 of course extends through the intermediate portion of the rod element 12 (not shown), and a suitable conventional switch 245 may be provided connected to the electric supply cable.

In the vacuum cleaner in accordance with the invention, smooth drive of the body element 10 occurs as a result of the driving of the rear wheels, in view of the weight distribution of the body element, with the center of gravity thereof between the front and rear wheels. In other words, the body element is driven from behind, rather than being pulled by the forward wheels, in order to obtain improved control and traction.

While the invention has been disclosed and described with reference to a single embodiment, it is apparent that variations and modifications may be made therein, and it is therefore intended in the following claims to cover each such variation and modification as falls within the true spirit and scope of the invention.

What is claimed is:

1. In a ground treatment apparatus having a body portion with ground engaging wheels and a motor, and an enlongated handle pivoted to said body portion for manual manipulation of said apparatus, and wherein coupling means are provided for coupling said motor to said wheels, manually operable control means are provided on said handle, and linking means are provided for controlling said first coupling means in response to said control means; the improvement wherein said coupling means comprises a common drive shaft for said wheels, first and second spaced apart gears having first and second drive faces respectively and being freely rotatably mounted on said shaft and coupled to said motor for continuous rotation in opposite rotational directions, and first and second clutch plates rotatable with said shaft and axially slidable thereon, said first and second clutch plates being positioned to be moved into and out of engagement with said first and second drive faces respectively, whereby only one of said faces can engage the respective clutch plates at any time and the clutch plates can be positioned at a neutral position with neither of them engaging its respective face, said linking means being a mechanical coupling and comprising means for selectively moving said clutch plates to engage said drive faces under the continuous control of said manually operable control means.

2. The ground treatment apparatus of claim 1 for a vacuum cleaner wherein said ground engaging wheels are floor engaging wheels, and said motor is coupled to drive a vacuum pump and a brush roll for said vacuum cleaner.

3. The apparatus of claim 2 wherein said coupling means comprises a pinion gear formed in the shaft of said motor, said motor having a vertical shaft, a second gear coupled to said pinion gear and mounted within said motor, and a cog belt drive coupled to said second gear, and means coupling said cog belt drive to drive said spaced apart gears.

4. The apparatus of claim 3 wherein said pinion and second gears are Evoloid gears.

5. The apparatus of claim 1 wherein said spaced apart gears are bevel gears having their teeth generally facing, and said coupling means comprises a bevel pinion gear mounted to engage the teeth of both said spaced apart gears, and means coupling said pinion bevel gear to be continuously driven by the shaft of said motor.

6. The apparatus of claim 5 further comprising a frame, said spaced apart gears and pinion bevel gear being rotatably mounted within said frame, and wherein said linking means comprises a yoke pivotally mounted within said frame and having fingers positioned to engage selectively said clutch plates to urge them against said drive faces, and means for pivoting said yoke.

7. The apparatus of claim 6 wherein said linking means further comprises a Bowden cable extending to said manually operable control means, and means coupling said Bowden cable to said yoke.

8. The apparatus of claim 7 wherein said means coupling said Bowden cable to said yoke comprises a link connected to be laterally shifted by said Bowden cable to thereby pivot said yoke, said link having a projection thereon, said link extending transversely and adjacent a lower end of said elongated handle, and wherein said elongated handle has a notch, and said link has a projection engageable with said notch at a determined position of said elongated handle to prevent movement of said link and thereby inhibit engagement of said clutch plate means with said faces.

9. The apparatus of claim 7 wherein said manual operable control means comprises a grip slidably mounted on an upper end of said elongated handle and connected to said Bowden cable.

10. The apparatus of claim 9 further comprising latch means on said manually operable control means for fixedly holding said manually operable control means against slidable movement with respect to said elongated handle.

11. The apparatus of claim 10 wherein said latch means comprises an aperture in said elongated handle, resilient means mounted in said manually operable control means and having a projection engageable with said aperture, and a manually controllable button positioned to be slidable to one position at which it urges said projection into engagement with said aperture and to another position at which said projection is resiliently biased away from said elongated handle.

* * * * *

REEXAMINATION CERTIFICATE (431st)

United States Patent [19] [11] B1 4,249,281

Meyer et al. [45] Certificate Issued Dec. 10, 1985

[54] SELF-PROPELLED VACUUM CLEANER

[75] Inventors: Robert B. Meyer; Harold W. Schaefer; Richard E. Kronmiller, all of Bloomington, Ill.

[73] Assignee: National Union Electric Corporation, Greenwich, Conn.

Reexamination Request:
No. 90/000,495, Jan. 31, 1984

Reexamination Certificate for:

| | |
|---|---|
| Patent No.: | **4,249,281** |
| Issued: | **Feb. 10, 1981** |
| Appl. No.: | **61,677** |
| Filed: | **Jul. 30, 1979** |

[51] Int. Cl.[4] ..... A47L 9/00
[52] U.S. Cl. ..... 15/340; 15/410
[58] Field of Search ..... 15/340, 410; 180/19 H; 192/48.9, 48.91, 51

[56] References Cited

U.S. PATENT DOCUMENTS

| | | | |
|---|---|---|---|
| 1,241,184 | 9/1917 | Wood | 192/21 |
| 1,361,875 | 12/1920 | Knittel | 192/51 |
| 1,435,903 | 11/1922 | Holmes | 272/21 |
| 1,459,946 | 6/1923 | Camarata et al. | 15/340 |
| 2,138,239 | 11/1938 | Irgens | 180/19.3 |
| 2,243,035 | 5/1941 | Hilkemeier | 192/48.9 |
| 2,619,209 | 11/1952 | Horn | 15/340 X |
| 2,814,063 | 11/1957 | Ripple | 15/340 X |
| 3,128,486 | 4/1964 | Kamman | 15/51 |
| 3,218,876 | 11/1965 | Berger | 15/340 X |
| 3,256,949 | 6/1966 | Petersen | 180/6.66 |
| 3,618,687 | 11/1971 | Ripple et al. | 15/340 X |
| 3,938,216 | 2/1976 | Schmitz et al. | 15/340 |

*Primary Examiner*—Christopher K. Moore

[57] ABSTRACT

An upright vacuum cleaner has a single motor on the body thereof, for rotating the vacuum producing fan blade, for rotating the rotary brush, as well as for driving the wheels by way of a clutch. The clutch is driven from the motor shaft by way of Evoloid gearing and a continuously driven bevel pinion, to drive oppositely rotating bevel gears. The handle grip of the cleaner is slidable along the end of the shaft or rod between the handle and the body, and controls a Bowden cable to effect the movement of a pair of clutch plates with respect to corresponding bevel gears, thereby to drive wheels on the body in a reversible manner.

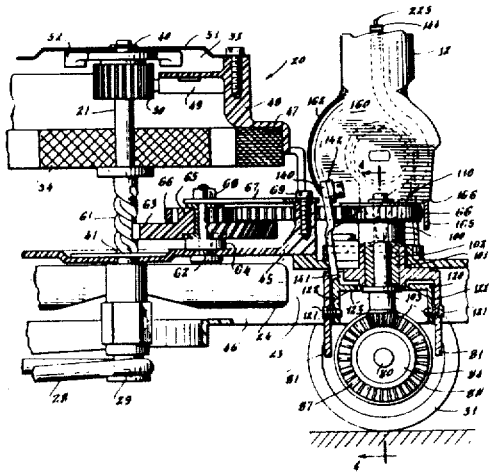

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 3, 4, and 6–11 is confirmed.

Claims 1, 2 and 5 are cancelled.

* * * * *